United States Patent [19]

Fitzgerald et al.

[11] Patent Number: 5,001,004

[45] Date of Patent: Mar. 19, 1991

[54] STAIN-RESISTANT AROMATIC/MALEIC ANHYDRIDE POLYMERS

[75] Inventors: Patrick H. Fitzgerald, Pitman, N.J.; Nandakumar S. Rao; Yashavant V. Vinod, both of Hockessin, Del.; George K. Henry; Kenneth S. Prowse, both of Newark, Del.

[73] Assignee: E. I. Du Pont de Nemours and Company, Wilmington, Del.

[21] Appl. No.: 502,819

[22] Filed: Apr. 2, 1990

Related U.S. Application Data

[63] Continuation of Ser. No. 280,407, Dec. 6, 1988, abandoned, which is a continuation-in-part of Ser. No. 136,038, Dec. 21, 1987, abandoned.

[51] Int. Cl.[5] ..... B32B 27/08; B32B 33/00; D06M 15/263

[52] U.S. Cl. ..... 428/263; 428/96; 428/267; 428/389; 428/395

[58] Field of Search ..... 252/174.24, 546; 428/96, 263, 267, 389, 395

[56] References Cited

U.S. PATENT DOCUMENTS

| | | | |
|---|---|---|---|
| 3,485,762 | 12/1969 | Gower et al. | 252/152 |
| 3,835,071 | 9/1974 | Allen et al. | 252/554 |
| 4,678,595 | 7/1987 | Malik et al. | 252/174.24 |
| 4,711,740 | 12/1987 | Carter et al. | 252/174.24 |

OTHER PUBLICATIONS

"SMA Resins the Multifunctional Resins", ARCO/-Chemical Co. Bulletin (1986).

"SMA Resins the Versatile Resins for Rug Shampoos", ARCO/Chemical Co., Bulletin (5/78).

*Primary Examiner*—James C. Cannon

[57] ABSTRACT

Stain-resistant, polyamide textile substrates treated with compositions comprising hydrolyzed ethylenically unsaturated aromatic/maleic anhydride polymers and processes for their preparation. The treated substrates possess stain resistance that is as good as or better than do previously known stain-resist treated substrates but do not suffer from yellowing to the extent that previously known treated substrates do.

14 Claims, No Drawings

STAIN-RESISTANT AROMATIC/MALEIC ANHYDRIDE POLYMERS

CROSS-REFERENCE TO RELATED APPLICATION

This application is a continuation of application Ser. No. 07/280,407, filed Dec. 6, 1988, now abandoned, which is a continuation-in-part) of Application Serial No. 136,038 filed Dec. 21, 1987, now abandoned.

FIELD OF THE INVENTION

The present invention relates to polyamide textile substrates treated with stain-resistant compositions comprising hydrolyzed ethylenically unsaturated aromatic/maleic anhydride polymers, and processes for their preparation. The substrates of this invention possess stain resistance but do not suffer from yellowing to the extent that previously known materials do.

BACKGROUND OF THE INVENTION

Polyamide substrates, such as nylon carpeting, upholstery fabric and the like, are subject to staining by a variety of agents, e.g., foods and beverages. An especially troublesome staining agent is FD&C Red Dye No. 40, commonly found in soft drink preparations. Different types of treatments have been proposed to deal with staining problems. One approach is to apply a highly fluorinated polymer to the substrate. Another is to use a composition containing a sulfonated phenol-formaldehyde condensation product.

For example, Liss and Beck, in U.S. Pat. Application Ser. No. 124,866, filed Nov. 23, 1987, disclose stain-resistant synthetic polyamide textile substrates having modified sulfonated phenolformaldehyde polymeric condensation products. However, sulfonated phenol-formaldehyde condenation products are themselves subject to discoloration; commonly they turn yellow. Yellowing problems are described by W. H. Hemmpel in a Mar. 19, 1982 article in *America's Textiles,* entitled *Reversible Yellowinq Not Finisher's Fault.* Hemmpel attributes yellowing to exposure of a phenol-based finish to nitrogen oxides and/or ultraviolet radiation. Critchley et al., *Heat Resistant Polymers; Technoloqically Useful Materials,* Plenum Press, N.Y. 1983, state that the thermo-oxidative stability of phenol-formaldehyde condensation products can be improved by etherifying or esterifying the phenolic hydroxyl groups.

To deal with the yellowing problem, Marshall, in U.S. Pat. No. 4,833,009 removes color-formers by dissolving the condensation product in aqueous base, acidifying the solution to form a slurry, heating the slurry so as to cause phase separation, recovering water-insoluble material and dissolving the water-insoluble material in aqueous base. On the other hand, Liss and Beck, in their aforesaid application, remove color-formers by acylating or etherifying some of the phenolic hydroxyls of the condensation product, and in a preferred embodiment, dissolving the modified condensation product in a hydroxy-containing solvent, such as ethylene glycol, prior to its being applied to the textile substrate.

Allen et al., in U.S. Pat. No. 3,835,071, disclose rug shampoo compositions which upon drying leave very brittle, non-tacky residues which are easily removed when dry. The compositions comprise water-soluble metal, ammonium or amine salt of a styrene-maleic anhydride copolymer, or its half ester, and a detergent. Water-soluble metal salts of Group II and the alkali metals (particularly magnesium and sodium) are preferred and ammonium salts are most peeferred by Allen et al.

BRIEF SUMMARY OF THE INVENTION

The present invention provides polyamide textile substrates treated with hydrolyzed ethylenically unsaturated aromatic/maleic anhydride polymers so as to impart stain resistance to the substrates, and methods for preparing the same. Commonly materials known in the past to be useful as stain blockers were sulfonated. Finding a non-sulfonated material, such as the hydrolyzed ethylenically unsaturated aromatic/maleic anhydride of this invention, to be useful for this purpose was unexpected.

DETAILED DESCRIPTION OF THE INVENTION

The hydrolyzed polymers suitable for the purposes of this invention contain between about one and two polymer units derived from one or more ethylenically unsaturated aromatic monomers per polymer unit derived from maleic anhydride (hydrolyzed polymers containing three ethylenically unsaturated aromatic polymer units per maleic anhydride polymer unit are not suitable). Hydrolyzed polymers containing about one polymer unit derived from one or more ethylenically unsaturated aromatic monomers per polymer unit derived from maleic anhydride are most effective in imparting stain resistance to textile substrates. A variety of ethylenically unsaturated aromatic compounds can be used for the purpose of preparing the hydrolized polymers of this invention. Those aromatic compounds can be represented by the formula.

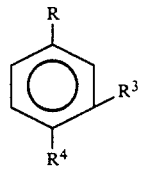

wherein

R is

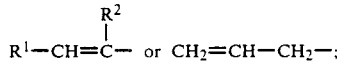

$R^1$ is H—,

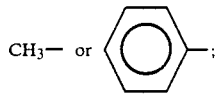

$R^2$ is H—or $CH_3$—:

$R^3$ is H—or $CH_3O$—;

$R^4$ is H—,

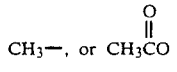

$R^3$ plus $R^4$ is

Specific examples of ethylenically unsaturated aromatic compounds suitable for the purposes of this invention include styren, alpha-methylstyrene, 4-methyl styrene, stilbene, 4-acetoxystilbene (used to prepare a hydrolized polymer from maleic anhydride and 4-hydroxy-stilbene), eugenol, isoeugenol, 4-allylphenol, acetate safrole, mixtures of the same, and the like. An attempt to prepare a polymer from a monomeric mixture containing maleic anhydride and 4-hydroxyl-stilbene failed. It is assumed that the hydroxyl group is implicated in such failure, and that the same results would be obtained with other monomers containing a phenolic hydroxy, such as eugenol, isoeugenol, 4-allylphenol and the like. Thus, the phenolic hydroxyl needs to be blocked, e.g., by acylating the same. From the standpoint of cost-effectiveness, a copolymer prepared from styrene and maleic anhydride at a 1:1 molar ratio is preferred. The hydrolyzed polymers can have molecular weights (number average) in the range between about 500 and 4,000, preferably between about 800 and 200. They are readily soluble, even at high concentrations, in water at neutral to alkaline pH; increasing dilution is needed at a pH below 6. They are also soluble in lower alchols, such as methanol, and are somewhat soluble in acetic acid.

The polymers suitable for the purposes of this invention can be prepared by hydrolyzing ethylenically unsaturated aromatic/maleic anhydride polymers. However, not just any hydrolyzing agent will give products of equivalent utility for the purposes of this invention. Alkali metal hydroxides are suitable hydrolyzing agents. While potassium and/or lithium hydroxides can be subtituted for sodium hydroxide in whole or in part as a hydrolyzing agent, the latter is preferred. Hydrolysis can be effected in the presence of more than or less than a molar amount of an alkali metal hydroxide, such as NaOH. But unless special measures are taken, hydrolysis of the polymer in the presence of ammonium hydroxide gives a product which does not provide satisfactory stainblocking properties to a polyamide textile substrate. Thus, if the polymer is hydrolyzed in the presence of ammonium hydroxide, it is essential that it be held at elevated temperature for an extended period of time thereafter; otherwise, the polymer imparts unsatisfactory stainblocking properties to polyamide substates. On the other hand, hydrolysis of the polymer in the presence of excess ammonium hydroxide results in a product which fails to impart satisfactory stainblocking properties to polyamide substrates even after having been held for an extended period of time at elevated temperature. Neither should hydrolysis be carried out in the presence of an alcohol. Even in the presence of any of the bases described above, the ethylenically unsaturated aromatic/maleic anhydride polymer can react with the alcohol to form a half-ester which will be deleterious to the stain-resist performance of the hydrolyzed polymers.

The hydrolyzed ethylenically unsaturated aromatic/-maleic anhydride polymers of this invention can be used as such in treating polyamide textile substrates. They can be applied to dyed or undyed polyamide textile substrates. They can be applied to such substrates in the absence or presence of a polyfluoroorganic oil-, water-, and/or soil-repellent materials. In the alternative, such a polyfluoroorganic material can be applied to the textile substrate before or after application of the hydrolyzed polymers of this invention thereto. The hydrolyzed polymers can be applied to textile substrates in a variety of ways, e.g. during conventional beck and continuous dyeing procedures. The quantities of the polymers of this invention which are applied to the textile substrate are amounts effective in imparting stain-resistance to staining of the substrate by acid dyes. The amounts can be varied widely; in general, one can use between 0.1 and 2% by weight of them based on the weight of the textile substrate, usually between 0.6% to 1.2% by weight. The polymers can be applied, as is common in the art, at pHs ranging between 4 and 5. However, more effective exhaust deposition can be obtained at a pH as low as 2. When pH of 2 is used, the preferred level of application to the textile substrate is about 0.6% by weight, based on the weight of the textile substrate. More effective stainblocking is obtained if the hydrolyzed polymers are applied to the textile substrate at higher temperatures. For example, at pH 2, 170° F. is preferred, and 200° F. is preferred at pH 5. However, stainblocking can be obtained when application is effected at room temperature, or even at that of cold tap water (10–15° C).

The hydrolyzed polymers of this invention can also be applied in-place to polyamide carpeting which has already been installed in a dwelling place, office or other locale. They can be applied as a simple aqueous preparation or in the form of aqueous shampoo preparation, with or without one or more polyfluoroorganic oil-, water-, and/or soil-repellent materials. They may be applied at the levels described above, at temperatures described, and at a pH between about 1 and 12, preferably between about 2 and 9.

The following Examples are illustrative of the invention. Unless otherwise indicated, all parts and percentages are by weight and temperatures in the Examples and Tests are in degrees Celsius. In the examples that follow, stain resistance and yellowing were measured by the techniques described below.

Exhaust Application of Stain-Resists to Carpetino Launder-O-Meter Method

Exhaust application of stain-resists to carpeting is carried out in a Launder-O-Meter automated dyeing machine. One carpet piece is contained in each of several (up to twenty) stainless steel, screw-cap canisters. The canisters are held in a rack that rotates in a water bath whose temperature is automatically controlled for rate of heating, time at temperature and cooling. For a typical application bath, one uses a 20 to 1 liquor to goods ratio with 2.5 weight % of the stain-resistant composition. The stain-resistant compositions can be applied at pH 2 or pH 5. At pH 2, an excess of sulfamic acid is used. At pH 5, an excess of ammonium sulfate is used, as well as 3g/L of magnesium sulfate and lg/L of an alkyl aryl sulfonate (Alkanol®ND) or a suitable leveling agent. After the bath is made up, a solution of the stain-resist composition is added to the Launder-o-Meter canister. The carpet sample to be treated is then placed in the canister, tufted side out, the size of the carpet sample, relative to the size of the canister, being such that the no portion of the sample touches another portion of the sample. The canisters are placed in the Launder-O-Meter and the water bath temperature is held at 110° F. for 5 minutes. The temperature of the water bath is then raised to the desired temperature for application of the stain-resist composition. For application at pH 2, the temperature of the water bath is raised to 170° F. ±5° F., and for application at pH 5, the temperature of the water bath is raised to 200° F. ±5° F. After the bath water reaches the desired temperature, it is held there for 20 min. and then cooled to 100.F. The treated carpet sample is removed from the canister and rinsed by squeezing in deionized water at room temperature. Three successive rinses in fresh deionized water are given, each rinse being at 40 volumes of water per volume of sample. The rinsed carpet sample is centrifuged to remove excess liquid and dried at 200° F. in a forced draft oven for 30 minutes. The dry carpet sample can then be tested by use of the tests described below.

Stain Tests

A. Stain Test A is used to measure the extent to which carpeting is stained by a commercial beverage composition which contains FD&C Red Dye No. 40 (an acid dye). The staining liquid, if sold commercially as a liquid, is used as is. Usually the commercial product is in the form of a solid. In that event, the beverage preparation, in dry, solid form, is dissolved in deionized water so as to provide 0.1 g of FD&C Red Dye No. 40 per liter of water. Sufficient wetting agent (Du Pont Merpol®SE liquid nonionic ethylene oxide condensate) is added to the dye solution to provide 0. g of the wetting agent per liter of dye solution Unless otherwise specified, the test sample is DuPont type 1150 Nylon 6,6 (white); Superba heatset, mock dyed level loop carpet, ⅜ inch pile height, 30 ounces per yard, 1/10 inch gauge, 10 stitches per inch, woven polypropylene primary backing. The test sample is wetted completely with water, and excess water is removed by centrifuging. The damp sample is placed tufted face down in a pan and covered with ten times its face weight of stain fluid. Entrained air is expelled from the sample by squeezing or pressing. The sample is turned over and again the air is expelled The sample is then returned to a face down position, and the pan is covered for storage for desired test period, namely 30 minutes or 24 hours. The stored stain sample is rinsed in running cool water until no more stain is visually detectable in the rinse water. The rinsed sample is extracted in a centrifuge and dried at 200 degrees F. Staining is evaluated with the Minolta Chroma Meter tristimulus color analyzer in the L*A*B Difference Mode with the target sample set for the unstained carpet. The "a" value is a measure of redness, with a value of 43 equal to that obtained on an untreated carpet.

In Stain Test B, a 6 inch ×6 inch (15 cm ×15 cm) specimen of carpet is placed on a flat non-absorbent surface. 20 1 of the staining fluid described in Stain Test A is applied to the specimen of carpet by placing a 1½ inch ×2 inch (3.8 cm x 5.1 cm) cylinder tightly over the specimen and pouring the staining liquid solution into the cylinder to contact the carpet specimen thereby forming a circular stain. The cylinder is then removed and excess staining solution is worked into the carpet tufts to achieve uniform staining. The stained carpet specimen is left undisturbed for 24 ±4 hours, after which it is rinsed thoroughly with cool water, squeezed dry, and excess solution removed. The stain resistance of the resulting carpet sample is visually determined by the amount of color left in the stained area of the carpet sample according to the following scale:

5 =no staining
4 =slight staining
3 =noticeable staining
2 =considerable staining
1 =heavy staining.

UV YELLOWING TEST

The light-fastness of carpet samples treated with a stainblocker is determined by exposing the treated samples to UV light for 20 Hours. A sample piece of carpet that has been treated with a stain-blocker is placed in a box containing its hinged top a standard fluorescent fixture fitted with two forty watt lamps. Centered under the pair of lamps in the bottom of the box is a sliding tray having a 3 inch ×40 inch recess for holding carpet specimens. The depth of the recess is such that the distance from the carpet face to the plane defined by the lamp surfaces is 1 inch. The current to the lamp is controlled by a timer so that a twenty-hour exposure can be obtained automatically. After the twenty-hour exposure, the reflectance of CIE White Light Source C from the carpet is compared with the reflectance from an unexposed sample and the CIELAB delta "b" noted. Delta "b" is a measure of the yellow component of white light. A Minolta Chroma Meter model CR-110 reflectance meter is used to make the measurements and to calculate delta "b" automatically from stored data on the unexposed sample. The value of "b" is reported as the measure of yellowing with increasing positive values of "b" corresponding to increased degrees of yellowing.

The Minolta Chroma Meter is used in the Hunter L*a*b color-deviation measuring mode [Richard Hunter, "Photoelectric Colorimetry with Three Filters," J. Opt. Soc. Am., 32, 509–538 (1942)]. In the measuring mode, the instrument measures the color differences between a "target" color, whose tristimulus color values have been entered into the microprocessor as a reference, and the sample color presented to the measuring head of the instrument. In examining carpet samples for yellowing and for FD&C Red Dye No. 40 staining, the "target" color entered is that of the carpet before yellowing or staining. The color reflectance of the yellowed or stained carpet is then measured with the instrument and reported as:

*E, the total color difference, *L, the lightness value,
*a, the redness value, if positive, or greenness, if negative, and
*b, the yellowness value, if positive, or blueness, if negative.

EXAMPLE 1

In a 7 gallon paste pail, 4800 gms of a 1/1 molar styrene/maleic anhydride copolymer having a number average molecular weight of 1600 (SMA 1000 from Sartomer) were stirred into 3000 gms of deionized water to give a smooth slurry. It dispersed well (no exotherm) in about 15 minutes Then over about 1 hour 5400 gms of 30% NaOH were added. The reactor was cooled during addition to maintain temperature in the 30–40° C. range. If the temperature went over about 40° C., addition of caustic solution was stopped. (Above 45°C., the polymer may melt and coagulate into large sticky globs which are very slow to hydrolyze.) After all of the NaOH solution has been added, the reaction mass was stirred for 15 minutes, then the reactor was heated to 70° C. and stirred for 3 hours. Heating was stopped, and 2800 gms of deionized water was added with stirring, following by cooling to 50° C. A light yellow, slightly viscous, clear alkaline solution of a polysodium salt of styrene/maleic acid copolymer was obtained.

The solution thus obtained was applied to nylon carpet at 2½ percent on weight of fiber in a simulated beck dyeing apparatus. The dried carpet was tested by saturating it with a solution of FD&C Red Dye No. 40 and letting it stand for ½ hour at room temperature (Stain Test A described above). It was then rinsed with cold water. The treated carpet showed no evidence of staining while an untreated control was deeply stained red. In a similar test the carpet was allowed to stand for 24 hours in the acid dye solution; on rinsing, the carpet treated with the above product solution of this Example 1 showed a noticeable pink stain while the untreated carpet was again stained a deep red. Carpets treated with the product solution of this Example 1 did not yellow on 24 hr. exposure to UV light (Yellowing Test described above).

Control

Example 1 was repeated using 2460 g. of ammonium hydroxide solution (28% $NH_3$) instead of the 5400 g. of sodium hydroxide. A product similar in appearance to the product from Example 1 was obtained. However, it provided little or no stain resistance in the ½ hr. Stain Test described above.

EXAMPLE 2

To 40 g. of SMA 1000 dispersed in 30 ml. of water were added over the course of 1¼ hrs. 72 g. of 30% by weight potassium hydroxide with cooling to maintain the temperature at 30–40°C. After addition was completed, the solution was stirred for 1 hr. without heating. The mass was allowed to stand overnight. In the morning, a trace of undissolved polymer was removed by filtration to yield the product which had stain resist and non-yellowing properties similar to the product of Example 1.

EXAMPLE 3

A solution of styrene (15.0 g., 0.14 mols), maleic anhydride (7.1 g., 0.14 mols), and dodecyl mercaptan (2.8 g., 0.014 mols), in toluene (101 g.) was heated to 70° C. under nitrogen. Vazo®67 initiator [2,2,'-azo-bis-(2-methylbutyronitrile)], 0.31 g., was added. A 10.C heat rise was noted. After the exotherm subsided, the reaction mass was heated for 6 hrs. at 70° C. The polymer solution was then cooled to 0° C. in an ice water bath. The resulting white polymer precipitate was filtered and suction dried to constant weight, 19.2 g. This material was hydrolyzed according to the procedure of Example 1. A light yellow somewhat opaque solution was obtained.

EXAMPLE 4

Example 3 was repeated using stilbene (20.0 g., 0.21 mols) and maleic anhydride (10.9 g., 0.21 mols), and dodecyl mercaptan (2.3 g., 0.011 mols). There obtained 29.2 g. of white polymer which on hydrolysis provided a white opaque dispersion with limited water solubility.

EXAMPLE 5

A solution of styrene (7.5 g., 0.072 mol), trans-stilbene (13.0g., 0.072 mol), maleic anhydride (14.1 g., 0.144 mol) and dodecyl mercaptan (2.6 g., 0.013 mol) in deoxygenated methylisobutyl ketone (150 g) was heated to 60° C. under nitrogen. To initiate polymerization, 2,2,'-azo-bis-(2-methylbutyronitrile) (0.3 gram Vazo® 67 brand) was added, resulting in a 5 C exotherm. After the exotherm subsided, the reaction mixture was heated for 8 hours at 70.C under nitrogen. Methylisobutyl ketone was then removed by distillation under reduced pressure, yielding a slightly off-white solid mass (36.8 g) which was hydrolyzed according to the procedure of Example 1, giving a clear light yellow solution Example 6

A cut pile, beige saxony carpet produced from 15 dpf Suessen set nylon 66 staple yarn, stain-resist treated (the composition of Example 9 of said Liss and Beck U.S. patent application) and latexed and finished with a secondary polypropylene backing at a carpet mill, was tested per Stain Test B, and was found to exhibit slight staining (i.e. a stain rating of 4). The carpet was cleaned in three passes with a 1:150 diluted shampoo (described below) using a Stanley Steemer truck mount. The carpet was treated in this manner "in place" at room temperature and was allowed to dry at room temperature. The dried treated carpet showed a very faint stain (a satisfactory stain rating of 4–5) when tested by Stain Test 2 (24 hours).

Shampoo Formulation

| Ingredient | % |
|---|---|
| Water | 48 |
| SMAC | 10 |
| Na $C_{12}$ $SO_4$ | 18 |
| PGME | 10 |
| DPM | 10 |
| Fluorosurfactant | 4 |
| Total | 100 |

EXAMPLE 7

Methyl isobutyl ketone (951.3 g) in a 4-neck 20 L flask fitted with mechanical agitation, codnenser, temperature controller, nitrogen bubbler and heating mantle was heated to 70 ° C. and sparged with nitrogen for one hour then cooled to room temperature. To this solutin were added maleic anhydride (98.06 g, 1.0 mol), stilbene (45.06 g, 0.25 mol), styrene (78.11 g., 0.75 mol), and dodecylmercaptan (16.6 g., 0.082 mol). This mixture was heated to a steady 70° C. with stirring under a nitrogen sweep. VAZO® 67 initiator [2,2,'-azobis--(2-methylbutyronitrile)](2.21 g, 0.0115 mol) was then added in one portion as a solid, no appreciable exotherm was noticed. The reaction was stirred at 70° C. for 3 hours then additional VAZO® 67 (1.1 G, 0.0057 mol) was added. The reaction continued to stir at 70° C. for another 3 hours, then it was cooled to room temperature. Approximately ¾ of the MIBK was then removed by rotary evaporation (or vacuum distillation at 10 mmHg). To the residual solution was added petroleum ether (ca. 1 L) to induce solidification of the polymer. The solid was collected by vacuum filtration and dried in a vacuum oven at 60° C. to give the terpolymer as a light yellow powder (233.9 g , 97% yield, MW = 1090 (VPO)).

To 560 g of water in a 4-neck 2.0 L flask fitted with mechanical agitation, temperature controller, condenser and heating mantle was added with stirring the terpolymer (200.0 g, ca. 0.84 mol). To this partially dispersed solution was added slowly at 30% sodium hydroxide solution (240 g, amount based on two mols of sodium hydroxide per mol of anhydride residue). The solution was heated to 80° C. and stirred for 6 hours. The reaction was cooled to room temperature and any large residual particles were removed by vacuum filtration through a large buchner funnel (6.8 g of solid was collected). A light yellow, slightly viscous, slightly cloudy alkaline solution of the polysodium salt of stilbene-styrene-maleic acid terpolymer was obtain (996 g, 99.5% yield 19.4% solids (active ingredient).

The product solution thus obtained was applied to nylon carpet at 5 percent (1 percent active ingredient) on weight of fiber in a simulated beck dying apparatus at a pH of 2.0. The dried carpet was tested by saturating it with a solution of FD&C Red Dye No. 40 and letting it stand for 24 hours at room temperature. It was then rinsed with cold water. The treated carpet showed no evidence of staining while an untreated control was deeply stained red. Carpets treated with the terpolymer alone did not yellow on 24 hour exposure to UV light.

In the simulated beck dying operation, a bath of the stain resist solution is made up in a glass screw cap container. A typical application bath utilizes a 20 to 1 liquor to goods ratio with 1.0 weight % of stain resist active ingredient on weight of fiber. An alkyl aryl sulfonate (Alkanol® ND) or suitable leveling agent is also added at 15 % leveling aqent on weight of stain resist active ingredient. The carpet piece (DuPont type 1150 Nylon 6,6 white; Superba heat set, mock dyed level loop carpet, 3/8 inch pile height, 30 ounces per yard, 1/10 inch gauge, 10 stitches per inch, woven polypropylene primary backing) is then fully immersed with the tuft side facing the center and no overlap. The required pH adjustment is then made. A pH of 2.0 is standard unless otherwise noted. All pH adjustments were accomplished utilizing an aqueous 30 % sulfamic acid solution. The jar is then capped and placed in a 70.C constant temperature water bath. The jar is removed after 40 minutes and the sample allowed to cool to room temperature. The carpet sample is removed, rinsed under running deionized water and squeezed dry by hand. The carpet thus prepared is then fully immersed in a screw cap jar containing 0.1 g of FD & C red dye # 40 per 1 liter of water. The jar is capped and the carpet allowed to stand in the solution for 24 hours. The carpet is removed and rinsed with tap water until no more stain is visually detectable in the rinse. The carpet is then dried in a 60xC oven and evaluated as described above.

EXAMPLE 8

A terpolymer was reepared in accordance with the procedure of Example 7, utilizing the following amotns of reactants and solvents:

MBIK (104.4 g)
Styrene (4.1 g, 0.04 mol)
Stilbene (10.8 g, 0.06 mol)
Maleic Anhydride (9.9 g, 0110 mol)
Dodecylmercaptan (1.4 g, 0.007 mol)
Vazo® 67 (0.26 g, 0.0013 mol).
Yield: 16.9 g The terpolymer was hydrolyzed in accordance with tghe proceudre of Example 7, utilizing the following amounts of reactants and solvents:

Terpolymer (10.0 g)
Deionized water (29.1 g)
Aqueous NaOH, conc. 30% (10.9 g).

EXAMPLE 9

A terpolymer was prepared in accordance with the procedure of Example 7, utilizing the following amounts of reactants and sovlents:

MIBK (101.6 g)
Styrene (5.2 g, 0.05 mol)
Stilbene (9.0 g, 0.05 mol)
Maleic Anhydride (9.8 g, 0.10 mol)
Dodecylmercaptan (1.4 g, 0.007 mol)
VAZO® 67 (0.25 g, 0.0013 mol).
Yield: 19.1 g The terpolymer was hydrolyzed in accordance with the procedure of Example 7, utilizing the following amounts of reactants and solvents Terpolymer (10.0 g)
Deionized water (28.9 g)
Aqueous NaOH, conc. 30% (11.1 g).

EXAMPLE 10

A terpolymer was prepared in accordance with the procedure of Example 8, utilizing the following amounts of reactants and solvents:

MIBK (98.4 g)
Styrene (6.2 g, 0.06 mol)
Stilbene (7.2 g, 0.04 mol)
Maleic Anhydride (9.8 g, 0.10 mol)
Dodecylmercaptan (1.4 g, 0 07 mol)
VAZO® 67 (0.24 g, 0.0012 mol)
Yield: 19.1 g The terpolymer was hydrolyzed in accordance with the procedure of Example 7, utilizing the following amounts of reactants and solvents:

Terpolymer (10.0 g)
Deionized water (28.5 g)
Aqueous NaOH, conc. 30% (11.5 g).

EXAMPLE 11

A terpolymer was prepared in accordance with the procedure of Example 7, utilizing the following amounts of reactants and solvents:

MIBK (92.4 g)
Styrene (8.3 g, 0.08 mol)
Stilbene (3.6 g, 0.02 mol)
Maleic Anhydride (9.8 g, 0.10 mol)
Dodecylmercaptan (1.4 g, 0.007 mol)
VAZO® 67 (0.23 g, 0.0012 mol)
Yield: 20.3 g The terpolymer was hydrolyzed in accordance with the procedure of Example 7, utilizng the following amounts of reactants and solvents Terpolymer (10.0 g)
Deionized water (28.2 g)
Aqueous NaOH, conc. 30% (11.8 g).

EXAMPLE 12

A terpolymer was prepared in accordance with the procedure of Example 7, utilizing the following amounts of reactants and solvents:

MIBK (92.4 g)
Styrene (8.3 g, 0.08 m01)
Stilbene (3.6 g, 0.02 mol)
Maleic Anhdyride (9.8 g, 0.10 mol)
Dodecylmercaptan (1.4 , 0.007 mol)
VAZO® 67 (0.23 g, 0.0012 mol)
Yield: 20.3

The terpolymer was hydrolyzed in accordance with the procedure of Example 7, utilizing the following amounts of reactants and solvents:

Terpolymer (10.0 g)
Deionized water (27.7 g)
Aqueous NaOH, conc. 30% (12.3 g).

EXAMPLE 13

A terpolymer was prepared in accordance with the procedure of Example 7, utilizing the following amounts of reactants and solvents:

MIBK (89.6 g)
Styrene (9.4 g, 0.09 mol)
Stilbene (1.8 g, 0.01 mol)
Maleic Anhydride (9.8 g, 0.10 mol)
Dodecylmercaptan (1.4 g, 0.007 mol)
VAZO® 67 (0.21 g, 0.0011 mol)
Yield: 19.6.g The terpolymer was hydrolyzed in accordance with the procedure of Example 7, utilizing the following amounts of reactants and solvents:

Terpolymer (10.0 g)
Deionized water (27.3 g)

EXAMPLE 14

To a 4-neck 1 L flask fitted with nechanical agitation, condenser, addition funnel, nitrogen bubbler, and temperature controller was added, in order, THF (450 g), triethylamine (I2.2 g, 0.12 mol), and 4-hydroxy stilbene (19.6 g, 0.10 mol). To this solution at room temperature was slowed added with stirring, via addition funnel, acetic anhdyride (12.3 g, 0.12 mol). When the addition of acetic anhydride was complete, the reaction solution was heated to 60° C. and held at this temperature with stirring for 2 hours. The reaction was cooled to room temperature then THF was removed in vacuo. The resulting residue was diluted with methylene chloride (500 mL) then extracted with 0.1 N HCl (1 ×500 mL), 30% saturated $NaHCO_3$ (1 ×500 mL) and saturated NaCl (1 ×500 mL). The organic layer was dried over anhydrous sodium sulfate then filtered and concentrated in vacuo to give the 4-acetoxy stilbene as a light tan needle-like crystalline powder (22.7 g, 95%).

EXAMPLE 15

Methyl isobutyl ketone (1025 g) in a 4-neck 5.0 L flask fitted with mechanical agitation, condenser, temperature controller, nitrogen bubbler and heating mantle was heated to 70° C. and sparged with nitrogen for one hour then cooled to room temperature. To this solution were added maleic anhydride (98.06 g, 1.0 mol), 4-acetoxy stilbene (59.6 g, 0.25 mol), styrene (78.11 g, 0.75 mol), and dodecylmercaptan (17.6 g, 0.087 mol). This mixture was heated to a steady 70° C. with stirring under a nitrogen sweep. VAZO® 67 initiator (2,2,'-azobis-(2-methylbutyronitrile)](2.3 g, 0.012 mol) was then added in one portion as a solid, no appreciable exotherm was noticed. The reaction was stirred at 70° C. for 3 hours then additional VAZO®67 (1.3 g, 0.067 mol) was added. The reaction was continued with stirring at 70.C for another 5 hours; then it was cooled to room temperature. Approximately ¾ of the MIBK was then removed by rotary evaporation (or vacuum distillation at 10 mmHg). To the residual solution was added petroleum ether (ca. 1 L) to induce solidification of the polymer. The solid was collected by vacuum filtration and dried in a vacuum oven at 60° C. to give the terpolymer as a light yellow powder 256 g, 100%).

To 689 g of water in a 4-neck 2.0 L flask fitted with mechanical agitation, temperature controller, condenser and heating mantle was added with stirring the terpolymer (256 g, ca. 1.0 mol). To this partially dispersed solution was added slowly a 30% sodium hydroxide solution (333 g, amount based on two mols of sodium hydroxide per mol of anhydride residue plus the amount needed to hydrolyze the acetate group on the phenolic hydroxyl). The solution was heated to 80° C. and stirred for 6 hours. The reaction was cooled to room temperature and any large residual particles were removed by vacuum filtration through a large buchner funnel. A light brown, slightly viscous, slightly cloudy alkaline solution of the polysodium salt of 4-hydroxy stilbene/styrene/maleic acid terpolymer was obtained (1264 g, 98.9% yield, 20% solids (active ingredient)).

The product solution thus obtained was applied to nylon carpet at 5 percent on weight of fiber (1 percent active ingredient) in a simulated beck dyeing apparatus as described in EXAMPLE 7 at pH 2.0, 2.5, and 3.0. At pH 2.0 there was no evidence of staining, pH 2.5 showed a barely discernable pink stain, pH 3.0 was noticeably stained, while the untreated carpet was deeply stained red. Carpets treated with the terpolymer alone did not yellow on 24 hour exposure to UV light.

EXAMPLE 16

A terpolymer was prepared in accordance with the procedure of Example 15, utilizing the following amounts of reactants and solvents:

MIBK (93.0 g)
Styrene (9.37 g, 0.09 mol)
b 4-Acetoxy Stilbene (2.38 g, 0.01 mol)
Maleic Anhydride (9.80 g, 0.10 mol)
Dodecylmercaptan (1.61 g, 0.008 mol)
VAZO® 67 (0.23 g, 0.0012 mol)
Yield: 19.7.

The terpolymer was hydrolyzed in accordance with the procedure of Example 15, utilizing the following amounts of reactants and solvents:

Terpolymer (10.0 g)
Deionized water (28.7 g)
Aqueous NaOH, conc. 30% (12.2 g)
Yield: 48.7 g.

EXAMPLE 17

A terpolymer was prepared in accordance with the procedure of Example 15, utilizing the following amounts of reactants and solvents:

MIBK (146.0 g)
Styrene (5.20 g, 0.05 mol)
4-Acetoxy Stilbene (11.9 g, 0.05 mol)
Maleic Anhydride (9.80 g, 0.10 mol)
Dodecylmercaptan (2.01 g, 0.0015 mol)
Yield: 24.6 g.

The terpolymer was hydrolyzed in accordance with the procedure of Example 15, utilizing the following amounts of reactants and solvents:

Terpolymer (10.0 g)
Deionized water (26.2 g)
Aqueous NaOH, conc. 30% (13.8 g)
Yield: 47.7 g.

EXAMPLE 18

Cumene (300 mls) was refluxed under nitrogen for one hour, cooled to 70° C. and 14.7 g of maleic anhydride was added, followed by 20.28 g of styrene and 0 0.44 g of VAZO® 67 White solids formed after 15 minutes. One hour after addition of the reactants was completed, the reaction mixture was cooled to room temperature and filtered. The resulting copolymer was then washed with 6 ×100 ml of petroleum ether. Yield of copolymer was 28.35 g. A portion of the copolymer (27.85g) was then added to 40 g of 30% sodium hydroxide solution and 53 g of water and heated at 70° C. for 6 hours. Yield was 111.6 g of a water solution of the hydrolyzed copolymer.

EXAMPLE 19

Methylisobutylketone (MIBK—100 mls) was heated to 70° C. with a stream of nitrogen bubbling below the surface of the liquid for 2½ hours. The nitrogen stream was then removed from below the surface. However, the system was kept under a nitrogen atmosphere. Maleic anhydride (9.8 g) was added along with 1.82 g of dodecylmercaptan, 14.5 g of styrene and 0.26 g of VAZO® 67 in that order. After heating for hours at 75° C., an additional 0.13 g of VAZO® 67 was added and the reaction maintained at this temperature for 3 more hours. Yield of copolymer was 27.0 g.

EXAMPLE 20

Cumene (300 mls) was refluxed for one hour. The temperature was then lowered to 75° C. and 14.7 g of maleic anhydride along with 30.0 g of eugenol acetate were added. Subsequently, 0.89 g of di-tert-butylperoxide was added. The reaction was then heated to 130° C. and kept there for 12 hours. The copolymer was then filtered and washed with petroleum ether yielding 35.5 g of purified copolymer.

EXAMPLE 21

Example 20 was repeated except eugenol acetate was replaced with isoeugenol acetate. Yield of copolymer was 38.7 g.

We claim

1. A stain-resistant polyamide textile substrate having deposited on it, in an amont effective to impart resistance to staining by acid dyes, a composition comprising a polymer containing between about one and two polymer units derived from one or more ethylenically unsaturated aromatic monomers per polymer unit derived from maleic anhdridge, which has been hydrolyzed in the presence of an alkali metal hydroxide or ammonium hydroxide and which has a number average molecular weight in the range between about 500 and 4000, said stain-resistant substrate which has said composition deposited on it being suitable for immediate use in carpeting, upholstery fabric, or the like.

2. The substrate of claim 1 wherein said amount is between 0.1 and 2% by weight and said ethylenically unsaturated aromatic monomer can be represented by the formula

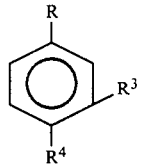

where

R is

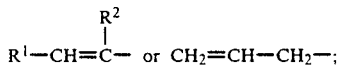

$R^1$ is H—, $CH_3$; or

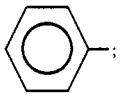

$R^2$ is H—or $CH_3$—;

$R^3$ is H—or $CH_3O$—;

$R^4$ is H—, $CH_3$—; or

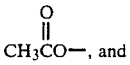

$R^3$ plus $R^4$ is —O—$CH_2$—O—.

3. The substrate of claim 1 wherein said ethylenically unsaturated aromatic monomer is styrene.

4. The substrate of claim 1 wherein said polymer contains about one polymer unit derived from maleic anhydride per polymer unit derived from one or more ethylenically unsaturated aromatic monomers.

5. The substrate of claim 1 wherein said polymer contains about one polymer unit derived from maleic anhydride per polymer unit derived from styrene.

6. The substrate of claim 1 wherein said polymer has been hydrolyzed in the presence of sodium hydroxide.

7. The substrate of claim 6 wherein said polymer contains about one polymer unit derived from maleic anhydride per polymer unit derived from styrene.

8. A process for imparting stain-resistance to a textile subsrate which comprises applying to said substrate, in an amount effective to impart to said substrate resistance to the staining effects of acid dyes, a composition comprising a polymer containing between about one and two polymer units derived from one or more vinyl-aromatic monomes per polymer unit derived from maleic anhydride, which has been hydrolyzed in the presence of an alkali metal hydroxide or ammonium hydroxide and which has a number average molecular weight in the range between about 500 and 400, thereby providing a stain-resistant substrate suitable for immediate use in carpeting, upholstery, or the like.

9. The substrate of claim 8 wherein said amoutn is between 0.1 2% by weight and said ethylenically unsaturated aromatic monomer can be represented by the formula

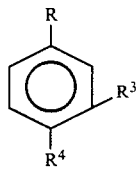

wherein

R is

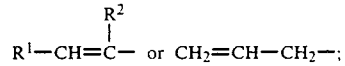

$R^1$ H—, $CH_3$; or

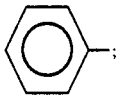

$R^2$ is H—or $CH_3$—;

$R^3$ is H—or $CH_3O$—;

$R^4$ is H—, $CH_3$—; or $CH_3\overset{O}{\overset{\|}{C}}O$—, and $R^3$ plus $R^4$ is —O—$CH_2$—O—.

10. The process of claim 8 wherein said ethylenically unsaturated aromatic monomer is styrene.

11. The process of claim 8 wherein said polymer contains about one polymer unit derived from maleic anhydride per polymer unit derived from one or more ethylenically unsaturated aromatic monomers.

12. The process of claim 8 wherein said polymer contains about one polymer unit derived from maleic anhydride per polymer derived from styrene.

13. The process of claim 8 wherein said polymer is hydrolyzed in the presence of sodium hydroxide.

14. The process of claim 13 wherein said polymer contains about one polymer unit derived from maleic anhydride per polymer unit derived from styrene.

* * * * *

UNITED STATES PATENT AND TRADEMARK OFFICE

CERTIFICATE OF CORRECTION

PATENT NO. : 5,001,004

DATED : March 19, 1991

INVENTOR(S) : Patrick H. Fitzgerald, Nandakumar S. Rao, Yashavant V. Vinod, George K. Henry and Kenneth S. Prowse It is certified that error appears in the above-identified patent and that said Letters Patent is hereby corrected as shown below:

Column 13, line 41, the word "anhdridge" should read -- anhydride --. Column 13, line 61, the word "where" should read -- wherein --.

Column 14, line 34, the word "subsrate" should read -- substrate --. Column 14, line 44, the number "400" should read -- 4000 --. Column 14, line 47, the word "amoutn" should read -- amount --. Also in line 48, the phrase "0.1 2%" should read -- 0.1 and 2% --.

Signed and Sealed this

Fourth Day of August, 1992

*Attest:*

DOUGLAS B. COMER

*Attesting Officer*

*Acting Commissioner of Patents and Trademarks*

UNITED STATES PATENT AND TRADEMARK OFFICE

CERTIFICATE OF CORRECTION

PATENT NO. : 5,001,004

DATED : March 19, 1991

INVENTOR(S) : Patrick H. Fitzgerald, Nandakumar S. Rao, Yashavant V. Vinod George K. Henry and Kenneth S. Prowse It is certified that error appears in the above-identified patent and that said Letters Patent is hereby corrected as shown below:

Column 14, line 47, the word "substrate" should read -- process --.

Signed and Sealed this

Nineteenth Day of October, 1993

Bruce Lehman

*Attest:*

BRUCE LEHMAN

*Attesting Officer*

*Commissioner of Patents and Trademarks*